US005163571A

United States Patent [19]

Morini

[11] Patent Number: 5,163,571

[45] Date of Patent: Nov. 17, 1992

[54] TWO-PART PLASTIC BOTTLE-CAP

[75] Inventor: Emilio Morini, Colorno, Italy

[73] Assignee: Bormioli Metalplast S.P.A., Parma, Italy

[21] Appl. No.: 773,233

[22] Filed: Oct. 9, 1991

[30] Foreign Application Priority Data

Oct. 17, 1990 [IT] Italy ..... 40134 A/90

[51] Int. Cl.[5] ..... B65D 41/34

[52] U.S. Cl. ..... 215/252; 215/258

[58] Field of Search ..... 215/252, 258, 274

[56] References Cited

U.S. PATENT DOCUMENTS

| | | | |
|---|---|---|---|
| 3,463,341 | 8/1969 | Fields | 215/252 |
| 4,197,960 | 4/1980 | Walter | 215/252 X |
| 4,805,791 | 2/1989 | Begley | 215/252 |
| 4,807,771 | 2/1989 | Roy et al. | 215/252 |

*Primary Examiner*—Stephen Marcus
*Assistant Examiner*—Paul A. Schwarz
*Attorney, Agent, or Firm*—Laff, Whitesel, Conte & Saret

[57] ABSTRACT

The invention relates to a plastic bottle cap in two parts. The first part (1) of said cap is annular-shaped and exhibits on its external lateral surface a plurality of projections (5), while the second part comprises a screw-up (2) inferiorly to which is connected a breakable seal (4) by means of easy-breaking webs (6); the cap exhibits a plurality of teeth (7), arranged parallel to the webs (6), which, on first screwing-on of the cap on to the bottle, are inserted between the projections (5) of the first part (1) and bear the forces which are generated during the screwing-on; since the teeth (7) are not connected to the breakable seal, the teeth (7) do not obstruct the detachment between the bottle-top and the breakable seal (4) when the cap is first unscrewed.

4 Claims, 1 Drawing Sheet fig.1
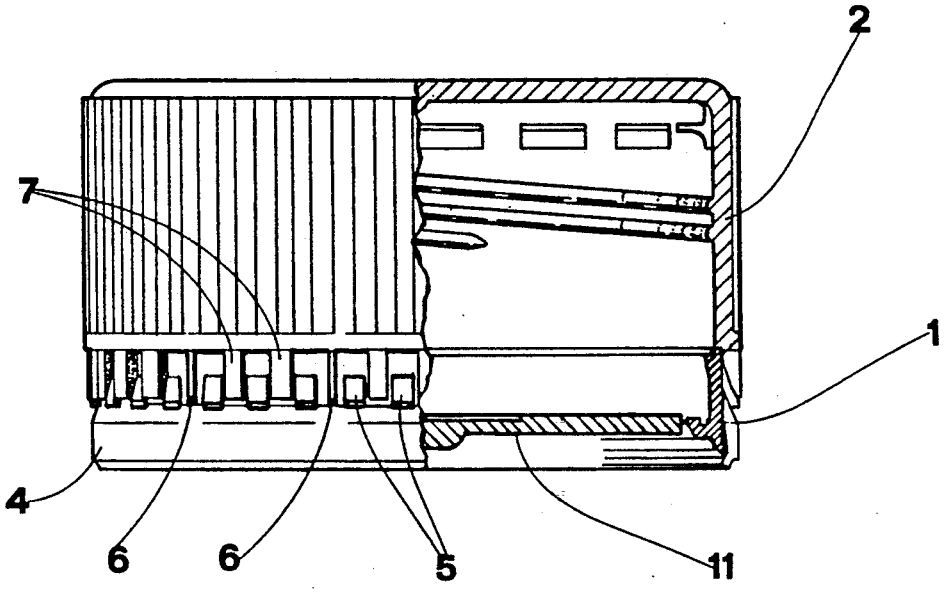
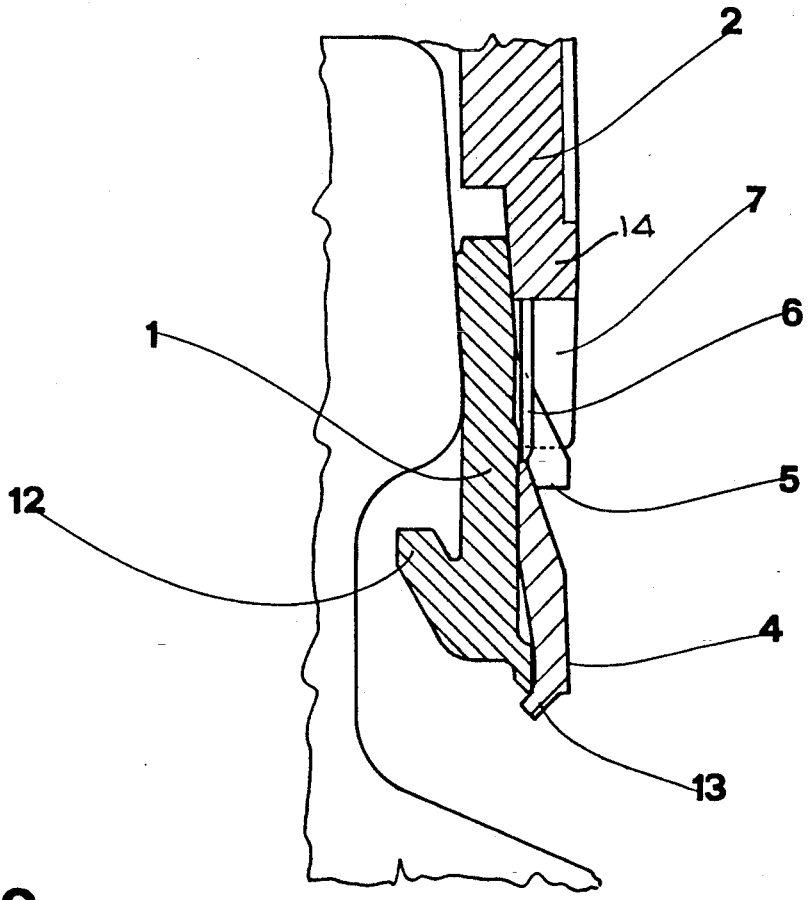
fig.2

TWO-PART PLASTIC BOTTLE-CAP

BACKGROUND OF THE INVENTION

The invention relates to a two-part plastic bottle-cap.

In bottle-caps of the type in question, apart from the problem of maintaining simplicity of construction, there exists the problem of permitting the screwing-on of the caps by means of fast automatic machines; also, there is the problem which is common to all caps which are equipped with a breakable seal, that of guaranteeing the consumer that the bottle has not been fraudulently opened.

One often satisfactory solution to this problem is obtained for example with the cap described in No. GB 2172273 by the same applicant. In that patent a cap is described which is equipped with a first, annular part which is inserted on the neck of the bottle and which exhibits, on its external lateral surface, a plurality of projections arranged in a ring; the second part of this cap comprises a screw-top inferiorly to which an annular breakable seal is attached by means of easily-broken webs. During the assembly phase of the cap, the second part is inserted on the first part in such a way that each strand of the web is arranged between two projections. When the cap is unscrewed for the first time, the web is broken by effect of traction in that the breakable seal, which on first screwing-up has been forced into a position below the lip of the bottle, is not able to follow the cap in its upward movement.

With respect to caps of this type, it has been noted that if the machines used for the first screwing-on of the caps on the bottles are particularly fast, and especially if the user of the caps allows wide margins with regard to the nominal diameter of the bottlenecks, the following can happen: if the bottlenecks are much wider than the nominal diameter, the web is broken on first screwing-on; if the neck is much narrower than the nominal diameter, there is the possibility of fraudulent opening due to the poor level of interference between the bottleneck and the cap.

Evidently it is not possible to strengthen the webs by thickening them, nor increase interference between the cap and the bottleneck; each of these solutions would address one of the problems while neglecting the other. It is therefore necessary to adopt web thicknesses and interference values which represent a compromise with regard to the solution of the above-described problems, even if by so doing, in the cases where the real diameter of the bottle is near to the maximum or minimum values permissible, one or the other of drawbacks may be encountered.

Another drawback encountered in caps of this type is that of the possibility of unscrewing the cap fron the bottle without breaking the webs, by levering beneath the cap itself using an appropriater tool. Although this operation is rather difficult to perform, the very fact that it is possible means that protection against fraudulent opening cannot be guaranteed.

Aim of the present invention is to eliminate the above-described drawbacks by providing a cap which is of simple construction, which permits of correct functioning with regard to both the first screwing-on phase and the unscrewing phase, with bottles that allow of an adequate tolerance of the nominal diameter and which is not removable from the bottleneck without one of its parts breaking.

An advantage of the present cap is that it permits of obtaining the desired results without any increase in production costs and without any further application complications.

SUMMARY OF THE INVENTION

These aims and advantages and others besides are attained by the invention as characterised in the claims which follow, which, as with the prior art cap illustrated in GB 2172273, is of the type in which the first annular-shaped part inserts on the neck of the bottle and exhibits on its external lateral surface a plurality of projections, arranged in a ring, and in which the second part, comprising a screw-top inferiorly to which is connected a breakable seal by means of easy-breaking webs arranged on an annular collar, inserts on the first part in such a way that each web is inserted between two projections so that the breakable seal ring stays axially slidingly solid to the first part. The invention further comprises resisting means, different from the said projections and being a part of the cap and aimed at resisting the forces which are generated between cap and seal ring during the first screwing-on phase of the cap on to the bottle; said resisting means being furthermore conformed and arranged in such a way as not to hinder the detachment of the cap from the breakable seal during the first unscrewing of said cap.

BRIEF DESCRIPTION OF THE ILLUSTRATIONS

Further characteristics and advantages of the present invention will better emerge from the description which follows, of one embodiment of the said invention, here illustrated in the form of a non-limiting example in the accompanying drawings, in which:

FIG. 1 shows a partially-sectioned vertical elevation of the cap;

FIG. 2 shows, in enlarged scale, a section of a particular of the cap.

DESCRIPTION OF THE PREFERRED EMBODIMENTS

The first part 1 of the cap is of annular shape and inserts on the bottleneck; said first part 1 exhibits, on its external lateral surface, a plurality of projections 5 arranged regularly in a ring around all the lateral surface of the first part 1. Internally to the first part 1 there is an angled rim 12 which, when the cap is inserted on the neck of the bottle, is forced to enter under said neck and thus prevents any further removing of the cap with the seal attached.

Usually the rim 12 is connected to an element such as, for example as illustrated in FIG. 1, a disc 11, which is made during production of the first part 1 of the cap and which, according to its nature, can have different functions; for example, the disc 11, once the cap has been inserted on the bottleneck, acts as a seal. Evidently, the element indicated by 11 can also have different functions, and in any case it is not a characteristic element of the invention in question.

The second part of the cap comprises a screw-top 2 inferiorly to which an annular breakable seal 4 is connected by means of easily-breaking webs 6. The webs 6 are arranged on an annular collar 14 which is the lower end of the screw top 2.

When the first and the second parts of the cap are coupled, the web 6 are inserted each between two of the projections 5 present on the first part of the capsule 1: a pairing is envisaged wherein the first part 1 of the cap and the breakable seal 4 are solid to axial sliding, in particular upwards axial sliding.

The second part, that is, the screw-top 2, also comprises teeth 7, which are arranged parallel to the webs 6 and on the same annular collar 14; the teeth 7 have a greater width with respect to the width of the webs 6 and are connected only to the screw-top 2. The lower ends of the teeth 7 are in fact free and therefore not connected to the breakable seal 4.

When the two parts 1 and 2 are assembled, each of the teeth 7 inserts between two projections 5. In FIG. 1 a cap is illustrated in which it is envisaged that in the annular collar 14 containing the teeth 7 and the projections 5 a sequence of two teeth 7 to one projection 5 is established; this conformation has been shown, as will be better described below, to be particularly efficient with regard to the good functioning of the cap. The width of the teeth 7 is equal to or slightly inferior to the distance between two projections 5, to provide for co-rotation of the first part one and the screw-up or second part two when the cap is first being placed on the bottle and for reasons that will be better described below.

The lower edge 13 of the breakable seal 4 has an internal diameter which is slightly smaller than the external diameter of the first part 1; in this way, when the two parts of the cap are assembled, the lower edge 13 overlaps the lower edge of the first part in such a way as to close it and make it externally inaccessible.

For reasons that will be better described below, the minimum internal diameter of the first part of the cap 1 can be made of such a diameter that a notable inferference is created on the bottleneck, even with bottlenecks having a diameter equal to the smallest diameter with respect to the nominal diameter. Furthermore, the rim 12 can be of considerable thickness, and consequently be highly rigid, so that the removal of the first part 1 from the bottleneck is prevented after first screwing-on has been achieved.

The cap in question functions as described below. At the moment of the first screwing-on to the bottleneck, the cap, which has been previously assembled, is forced and screwed on to the bottleneck itself; during this operaiton, the teeth 7 and projections 5 interact to have the first part 1 and the second part 2 co-rotate and, differently from prior art procedures, the forces which are generated in the annular zone, containing the teeth 7, the webs 6 and the projections 5, forces generated by the friction which is created by the forcing of the rim 12 on to the bottleneck, are all borne by the teeth 7, and are not unloaded on to the webs 6; in this way, even when these forces are of notable strength, the webs 6 are not at all subject to them and therefore do not break. This permits of maintaining a high interference between the rim 12 and the bottleneck as well as a high rigidity of the rim 12, which ensures that the cap stays very firmly on the bottle once the screwing-on procedure has been carried out.

During the first unscrewing phase, the screw-top 2 is unscrewed from the bottleneck; the teeth 7 draw the first part of the cap 1 into rotation, which is in any case free to rotate about the bottleneck; contemporaneously the cap lifts. While the lifting of the second part of the cap, and in particular of the bottletop itself, is not prevented by any other element, the lifting of the first part 1 and of the breakage seal 4 which is axially slidably solid to it is prevented by the rim 12. When the unscrewing operation is continued, the breaking by traction of the webs 6 occurs, confirming that opening of the cap has taken place.

Obviously, according to the necessities of construction the thickness of the webs 6 can be kept very small since, as stated above, the webs 6 do not bear any force during the phase of screwing-on but have only to break easily during the first unscrewing phase. The particular shape of the lower edge of the breakable seal 4 prevents any attempt at opening it with a tool by levering between the breakable seal 4 and the first part 1 of the cap; it is also worthy of note that the webs 6, being of very small thickness, at least partially break at any attempt at tampering with the cap.

It is to be noted that the same function of the lower edge 13 of the breakable seal 4 might be obtained for example by glueing or soldering the breakable seal 4 and the first part 1; the system utilised for the prevent cap, however, is simpler and does not require the use of glues and solders.

What is claimed:

1. A two part plastic cap for bottles having a first annular-shaped part, said first part having an external lateral surface with a plurality of projections arranged in a ring around said external lateral surface.

a second part, said second part having a screw-top, a breakable seal, and a plurality of easy-breaking webs arranged on an annular collar of said screw top, each of said webs is inserted between two of said plurality of projections, a plurality of teeth arranged parallel to said webs and on the annular collar, said teeth having a greater width with respect to the width of said webs, said teeth having one free end and being connected to the lower end of the screw-top at the other end; said teeth being conformed in such a way as to be inserted each between two of said plurality of projections when the second part of the cap is inserted on the first part; and the width of each said teeth is equal to or slightly smaller than the distance existing between two of said plurality of projections.

2. A two part plastic cap for bottles having a first annular-shaped part, said first part having an external lateral surface with a plurality of projections arranged in a ring around said external lateral surface.

a second part, said second part having a screw-top, a breakable seal, and a plurality of easy-breaking webs arranged on an annular collar of said screw top each of said webs is inserted between two of said plurality of projections, a plurality of teeth arranged parallel to said webs and on the annular collar, said teeth having a greater width with respect to the width of said webs, said teeth having one free end and being connected to the lower end of the screw-top at the other end; said teeth being conformed in such a way as to be inserted each between two of said plurality of projections when the second part of the cap is inserted on the first part; and wherein there are equal sequences of two of said plurality of teeth and one of said plurality of webs.

3. A two part plastic cap for bottles having a first annular-shaped part, said first part having an external lateral surface with a plurality of projections arranged in a ring around said external lateral surface, a second part, said second part having a screw-top, a breakable seal, and a plurality of easy-breaking webs arranged on an annular collar of said screw top, a lower edge of the breakable seal has an internal diameter which is slightly smaller than an external diameter of the first part; each of said plurality of webs is inserted between two of said plurality of projections, and resisting means different from the said projections, said resisting means being a part of the cap to co-rotate the first part and the second part during the first screwing on phase and to resist the forces which are generated between the screw top and the breakable seal during the first screwing-on phase of the cap on to the bottle; said resisting means being furthermore conformed and arranged in such a way as not to hinder the detachment of the screw top from the breakable seal during the first unscrewing of said cap.

4. A cap as in claim 3 wherein the resisting means is a plurality of teeth on the lower end of the screw cap and each of said plurality of teeth extending between two of said plurality of projections.

* * * * *